United States Patent [19]

Tanaka

[11] 4,400,702

[45] Aug. 23, 1983

[54] SHORTENED ANTENNA HAVING COAXIAL LINES AS ITS ELEMENTS

[76] Inventor: Hiroki Tanaka, 1071-2, Hayashigaki, Wadayama-cho, Asago-gun, Hyogo-ken, Japan

[21] Appl. No.: 253,195

[22] Filed: Apr. 13, 1981

[30] Foreign Application Priority Data

May 13, 1980 [JP] Japan ..... 55-63755

[51] Int. Cl.[3] ..... H01Q 9/42

[52] U.S. Cl. ..... 343/790; 343/806

[58] Field of Search ..... 343/790, 791, 845, 846, 343/806

[56] References Cited

U.S. PATENT DOCUMENTS

| | | | |
|---|---|---|---|
| 2,115,761 | 5/1938 | Blumlein | 343/790 |
| 3,031,668 | 4/1962 | Bryson | 343/790 |
| 4,161,736 | 7/1979 | Goodman | 343/845 |

*Primary Examiner*—Eli Lieberman

*Attorney, Agent, or Firm*—Eugene E. Geoffrey, Jr.

[57] ABSTRACT

A modified line antenna, having reduced length and space of occupancy, each element of which is divided into a plurality of segments which are made of coaxial lines connected in series with a novel inventive technique and folded into a short and compact structure at the points of connection without any loss of overall efficiency.

3 Claims, 15 Drawing Figures

SHORTENED ANTENNA HAVING COAXIAL LINES AS ITS ELEMENTS

This invention relates generally to a line antenna, and especially to a novel and improved structure of such antenna, which enables significant reduction of the length and space of occupancy of the antenna.

It has been the general practice to make the whole length of a line antenna substantially equal to one-half wavelength, or a quarter wavelength in case of grounded antenna, of the electric wave to be handled, because it has been well known in the art that the overall efficiency would be reduced when a shorter antenna is used. In the case of handling waves of long wavelength, therefore, a disadvantage has been encountered in that a very large space must be provided for the antenna as compared with the transmitter or receiver, or that the antenna must be shortened at the sacrifice of its efficiency. Although it has been proposed to connect a reactance element at an antenna to reduce its length, this cannot result in any significant reduction. The basic theory as discussed above can be seen, for example, in "Antenna Technology Handbook" edited by The Japanese Institute of Electronic Communication and published by Ohm-sha, Tokyo, in 1980. With recent developments of electronic component technique, the bodies of transmitters and receivers have become remarkably small and compact and even portable. However, it has been a difficult problem to reduce the size of the antenna itself due to restriction of the above theory.

The inventor has found that the length and space of occupancy of a line antenna can be reduced remarkably by dividing each element of the antenna into a plurality of segments made of coaxial lines and suitably connecting the inner and outer conductors of the respective segments. More particularly, a line antenna according to this invention comprises a plurality of segments made of coaxial lines, respectively, and connected in series, and the inner and outer conductors of one of the coaxial lines adjoining at each point of connection are connected respectively to the outer and inner conductors of the other coaxial line.

These and other features and operation of this invention will be described in more detail hereinunder with reference to the accompanying drawings.

IN THE DRAWINGS

Throughout the drawings, like reference numerals are used to denote corresponding structural components.

Figure 1:
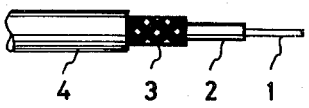
FIG. 1 is a schematic view representing a structure of coaxial lines used in the embodiments of this invention.

Referring to FIG. 1, there is shown a structure of a commercially available coaxial cable, which is used for making the elements of antennas produced experimentally in accordance with this invention, comprising an inner conductor 1, a polyethylene inner insulator 2, an outer conductor 3 and a polyvinylchloride outer insulator 4. By way of trial, two kinds of coaxial cable, types 3C2V" and "1.5D2V", were used. The inner conductor of the former is a soft copper wire of 0.5 millimeter diameter and that of the latter is a stranded wire consisting of seven soft copper wires of 0.18 millimeter diameter, while the outer conductors of both are single braids of soft copper wires. Some parameters of the inner and outer insulators 2 and 4 according to Japanese Broadcasting Standards are given in the following table.

| | Inner Insulator | Outer Insulator | |
|---|---|---|---|
| Type | Outer diameter (mm) | Thickness (mm) | Outer diameter (mm) |
| 3C2V | 3.1 | 1.0 | 5.8 |
| 1.5D2V | 1.6 | 0.4 | 2.9 |

Both types exhibit the same wavelength reduction factor of 0.67.

Figure 3:
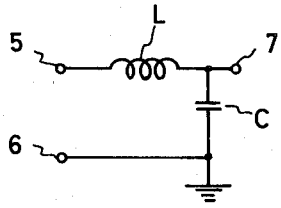
FIG. 3 is a schematic view representing a matching circuit used in the embodiments of this invention.
Figure 2:
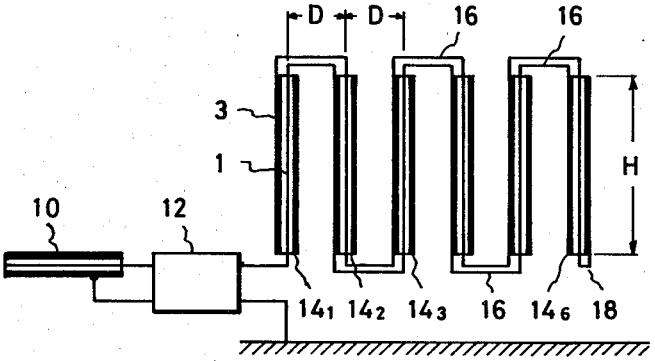
FIG. 2 is a schematic view representing an embodiment of the antenna according to this invention.

FIG. 2 shows, in highly conceptual fashion, a grounded antenna of a first embodiment of this invention for a signal frequency of 14,399 KHz. A feeder 10 (coaxial cable having a characteristic impedance of 50 ohms) from a transmitter (not shown) is coupled through a matching circuit 12 to the ground by one conductor and to an inner conductor 1 of a first segment $\mathbf{14}_1$ of antenna element by the other conductor. As shown in FIG. 3, the matching circuit 12 has an LC circuit configuration including an inductance L connected between a first input 5 and an output 7 and a capacitance C coupled between a second input 6 which is grounded and the output 7. The antenna element is divided into six segments or strands $\mathbf{14}_1$ through $\mathbf{14}_6$ which are connected in series and arranged in parallel in a same plane at equal intervals D of 2 centimeters. Each of the segments or strands consists of a coaxial cable of type 3C2V having the same length H of 50 centimeters. At the ends of the adjoining strands, the inner and outer conductors 1 and 3 of one coaxial cable are connected respectively to the outer and inner conductors 3 and 1 of the other cable with lead conductors 16 (hereinunder referred to as "inverse connection") and the inner and outer conductors 1 and 3 are shorted at the final end 18. Therefore, the whole length of the element is 300 centimeters, which is a little shorter than 350 centimeters obtained by multiplying a quarter wavelength of 520 centimeters for the selected frequency by the wavelength reduction factor of 0.67. This is a result of adjustment for equalizing the selected frequency to the resonance frequency.

The input impedance of this antenna was measured as 155 ohms. In order to provide matching with the feeder 10 having a characteristic impedance of 50 ohms, the elements of the matching circuit 12 were selected as: $L=0.8\ \mu H$ and $C=107$ pF. When the antenna was fed with power under this condition, the voltage-to-standing wave ratio (VSWR) was measured as less than 1.05.

As the quality factor (Q) of the coil L of the matching circuit 12 was 105, its resistance was calculated as 0.7 ohm and the loss of the coaxial cable 3C2V of the antenna was found to be 0.05 dB/meter at 15 MHz frequency. These values are neglegibly small as compared with the grounding and radiation resistances. Accordingly, the overall efficiency of the antenna has not been affected by miniaturization according to this invention, since it is a function of the grounding resistance only. On the contrary, the whole length of 530 centimeters of the prior art quarter wavelength grounded vertical antenna has been reduced below one-tenth by this invention.

The reason why the antenna of this invention exhibits the same function as the prior art antenna is considered as follows. At the lower end of the strand $14_1$ which is the feeding point of the antenna, balance-to-unbalance conversion is effected and an unbalanced current flows through the strand $14_1$. At each point of connection, unbalance-to-balance-to-unbalance conversion is effected and an unbalanced current flows through the next strand. Thus, unbalanced currents of the same phase flow through the respective strands, since the current inverts its phase with inversion of the sense of strand.

Figure 4:
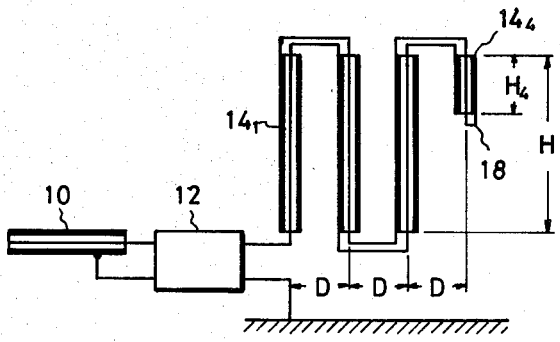
FIGS. 4 through 10 are schematic views representing other embodiments of the antenna according to this invention.

FIG. 4 is a similar diagram to FIG. 2, which shows a grounded antenna of a second embodiment of this invention used at a frequency of 52 MHz. In this embodiment, the antenna element is composed of three strands $14_1$, $14_2$ and $14_3$ having a length H of 29 centimeters each and a strand $14_4$ having a length $H_4$ of 10 centimeters. The respective strands are sequentially connected in "inverse" fashion and the final end 18 is short-circuited. The strands are made of coaxial cables 1.5D2V and arranged at equal intervals of D=1 centimeter. The input impedance of this antenna was measured at 185 ohms. When the matching circuit 12 was composed of L=0.25 μH and C=27 pF, the VSWR was measured as less than 1.1 within a frequency range of 49 to 54 MHz.

As the Q of the coil L was measured as 83, the resistance of the coil is one ohm and the loss of the coaxial cable is less than 0.3 dB/meter. Accordingly, there would be no reduction in the overall efficiency. On the other hand, the length of antenna has been reduced to 29 centimeters which is about one-fifth of the necessary length of about 150 centimeters of a quarter wavelength grounded vertical antenna.

Figure 5:
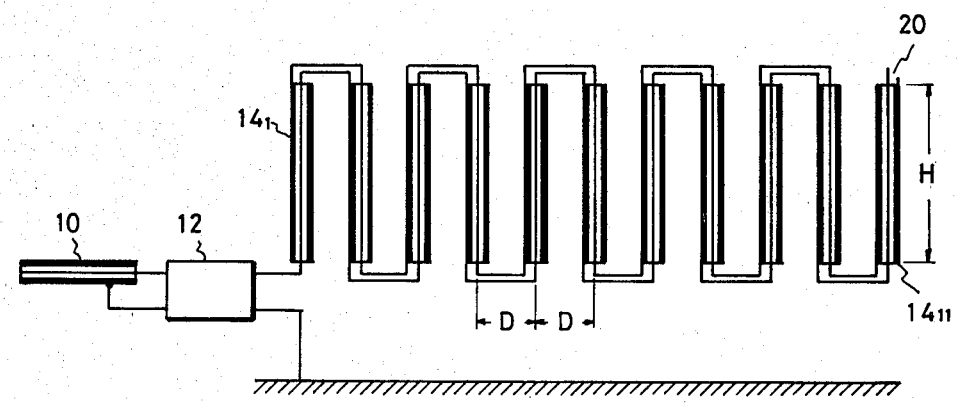

FIG. 5 shows a similar view of a third embodiment of this invention which is a grounded antenna used at a frequency of 145 MHz. The element of this antenna is composed of eleven (11) pieces of coaxial cable 1.5D2V having a length H of 5 centimeters each. The respective strands $14_1$ through $14_{11}$ are similarly "inverse-connected" and the inner and outer conductors at the final end 20 are opened but not shorted. In this case, the whole length of the antenna is 55 centimeters which is a little shorter than 69 centimeters which is a product of the quarter wavelength of 103 centimeters and the wavelength reduction factor of 0.67. However, the length of 5 centimeters of the strand, which is the practical length of the inventive antenna, is only about one-tenth of the whole length of about 50 centimeters of the corresponding prior art quarter wavelength antenna. When the strands are arranged in a plane at intervals of D=7 millimeters, the whole antenna can be included within a small area of $5\times7$ cm$^2$. The input impedance of this antenna was measured at 203 ohms. Using a matching circuit of L=0.1 μH and C=10 pF and feeding a power similarly, the VSWR was measured as less than 1.1 within a frequency range of 144 to 146 MHz. As the Q of the coil L was 85, the resistance of the coil was one ohm and the loss of the coaxial cable was 0.4 dB/meter. These values should not affect at all the overall efficiency of the antenna.

Figure 6:
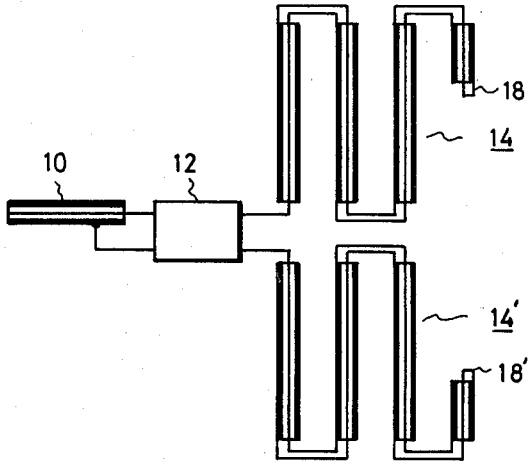

FIG. 6 shows a fourth embodiment of this invention to be used at 52 MHz frequency. This is a similar view of a non-grounded antenna which corresponds to the grounded antenna of FIG. 4. In this antenna, a pair of elements each composed of the same material and the same geometry as those of the element of FIG. 4 are arranged facing each other. Although the input impedance was supposed to be smaller than twice the input impedance of the grounded antenna of FIG. 4 by the grounding resistance, it was measured as 432 ohms. The matching circuit 12 was required in case of feeding with a coaxial cable of 50 ohms, but the overall efficiency would be nearly 100 percent since the matching loss could be negligible similarly.

In the above embodiments, the respective strands or segments of the antenna element were shown as being straight and parallel to each other. However, the same effect can be expected when the strands are arranged so that unbalanced currents flow through the whole antenna even if they are folded or curved.

Figure 7:
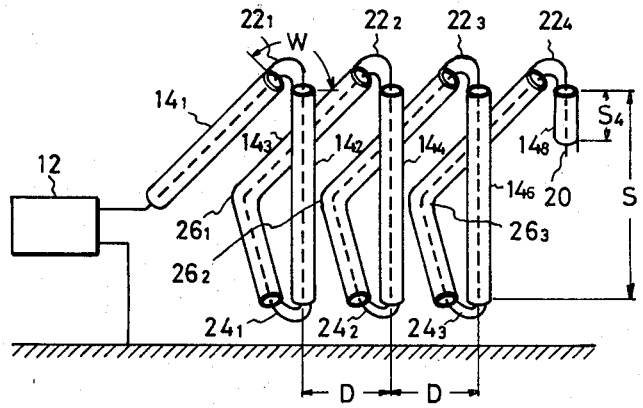

FIG. 7 shows a fifth embodiment of this invention to be used at 145 MHz frequency, the element of which is composed of eight strands $14_1$ through $14_8$ made of coaxial cable 1.5D2V. Every other strand $14_3$, $14_5$ and $14_7$ is folded at an angle of 60 degrees at their middle portions $26_1$, $26_2$ and $26_3$ and arranged to form helically stacked regular triangles having a side length S of 5 centimeters and a pitch D of one centimeter. The length of the last strand $14_8$ is one centimeter. The strands are successively "inverse-connected" as aforementioned with conductors $22_1$ through $22_4$ and $24_1$ through $24_3$ having a length W of about 7 millimeters each, and the final end 20 is opened.

The fact that unbalanced currents of same phase tend to flow through all strands of this antenna element can be explained in the same manner as the embodiment of FIG. 2. The electric fields induced by the pairs of sides of the folded strands $14_1$, $14_3$, $14_5$ and $14_7$ are combined at a great distance and become to have the same phase as the electric field induced by the strands $14_2$, $14_4$, $44_6$ and $14_8$ so that the strands function as a single antenna element. This antenna is considered as a modification of the antenna of FIG. 5 and has an input impedance of 207 ohms. While it can function as same as the antenna of FIG. 5, it may be advantageous due to its fewer number of strands.

Figure 8:
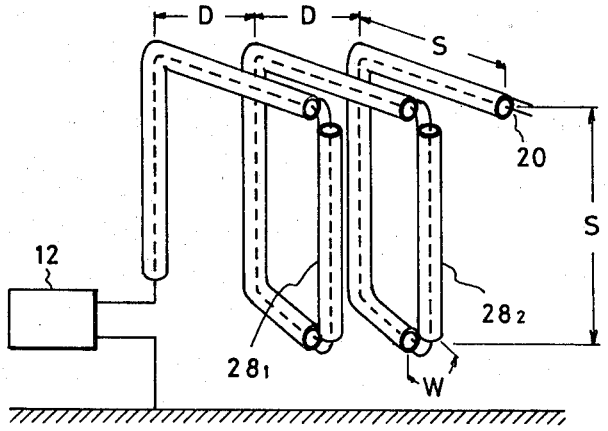

FIG. 8 shows a modification of the embodiment of FIG. 7, the applicable frequency and the material of strands are same as those in FIG. 7. This antenna has a shape of helical squares having a side length S of 5 centimeters and a pitch D of one centimeter. "Inverse connections" are made only at both ends of the sides $28_1$ and $28_2$ of the squares, respectively, with conductors having a length W of about 7 millimeters each, and the final end 20 is opened. In this antenna, wherein every other strand of which has two folded points each, is theoretically the same as that of FIG. 7. Its input impedance was measured as 305 ohms and it has been found to operate similarly.

Figure 9:
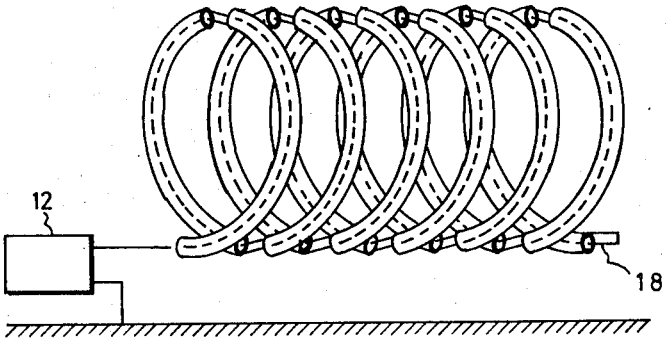

FIG. 9 shows a further embodiment in which a coaxial cable is formed into a helix and cut at both ends of the diameters and then the inner and outer conductors are "inverse connected" respectively at the respective cut points. Since this is equivalent to those aforementioned having straight strands which are alternatively curved into circular arcs alternately in opposite directions, a function similar to the embodiments of FIGS. 7 and 8 can be expected easily.

Figure 10:
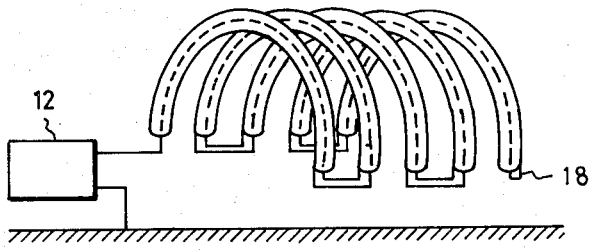

FIG. 10 shows another modification formed by bending the straight strands as aforementioned into circular arcs in the same direction, which is expected to function similarly.

While several structures of antenna based upon the principle of this invention have been described, various modifications can be considered further. In the embodiments of FIGS. 9 and 10, for example, the strands may be bent into any shape other than circular arcs, for example, into polygonal shapes. Although a coaxial cable which is commercially available has been used as the material of strands, the strands can take any other form, including that having air as the insulator, so long as they constitute coaxial lines. The outer insulator 4 (FIG. 1) may be omitted as occasion demands.

Figure 11:
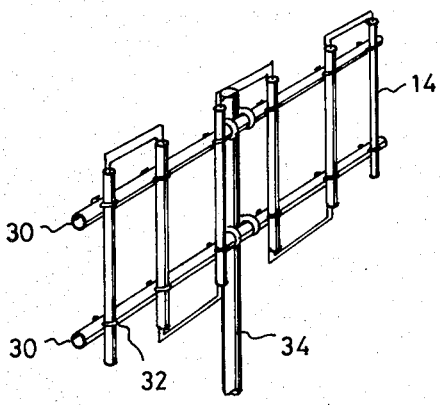
FIGS. 11 and 12 are perspective views representing two examples of practical arrangements of the antennas of FIGS. 1 and 5, respectively.
Figure 12:
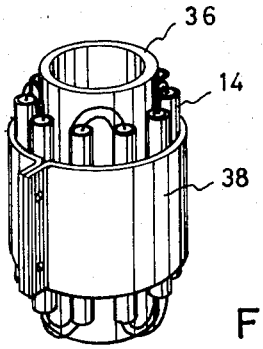

In case of putting the antennas of this invention into practical use, it is necessary to fix the respective strands to a suitable frame or support. FIG. 11 shows an example thereof, in which the strands 14 are fixed with fixtures 32 to horizontal arms 30 which are in turn fixed to a vertical post 34. Straight strands may be not only arranged in parallel in a plane as shown in FIG. 11, but also arranged circularly around a suitable insulating bobbin 36 and tightened by a belt strip 38 as shown in FIG. 12. The structure of FIG. 12 will become more convenient to carry when it is enclosed in a suitable dielectric casing, Though a variety of supporting methods of the antennas can be considered further, no description will be made since they do not constitute the subject of this invention.

Figure 13:
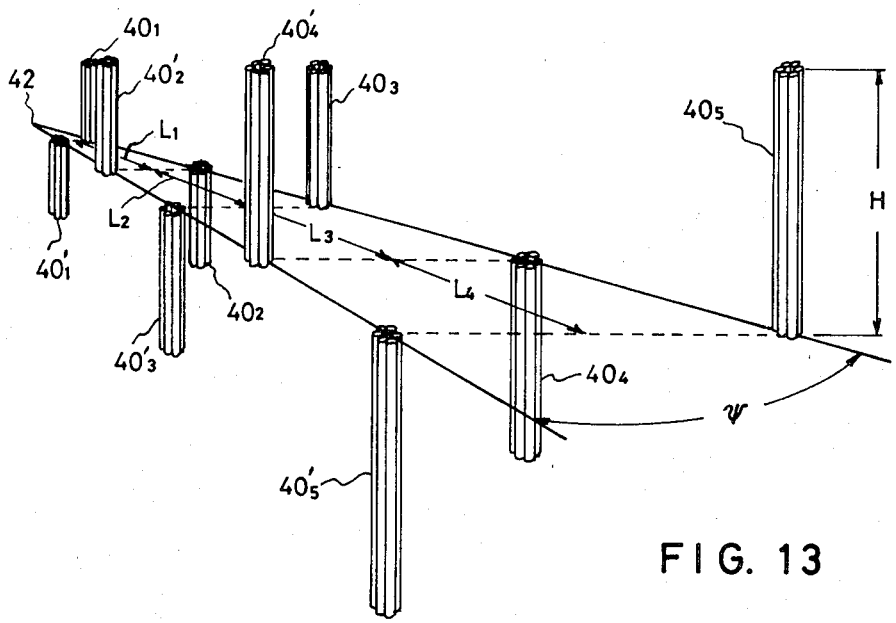
FIGS. 13 and 14 are schematic perspective views representing two embodiments of log-periodic antenna utilizing the principle of this invention.
Figure 14:
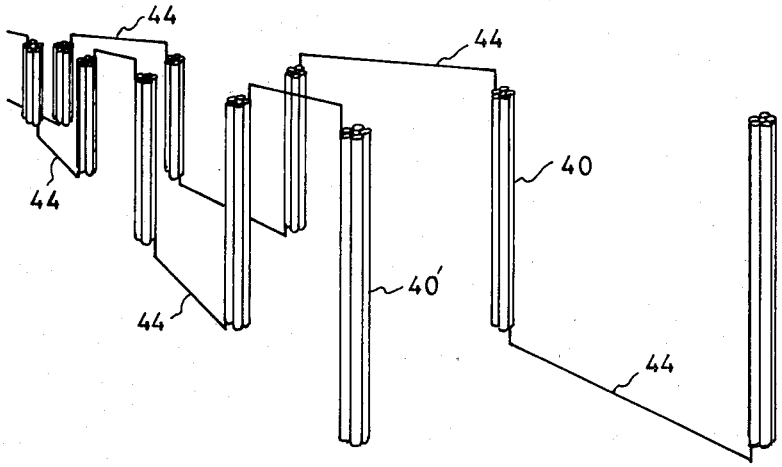

FIGS. 13 and 14 are schematic views of log-periodic antennas having elements each composed of a plurality of strands which are fixed in the manner as shown in FIG. 12.

Figure 15:
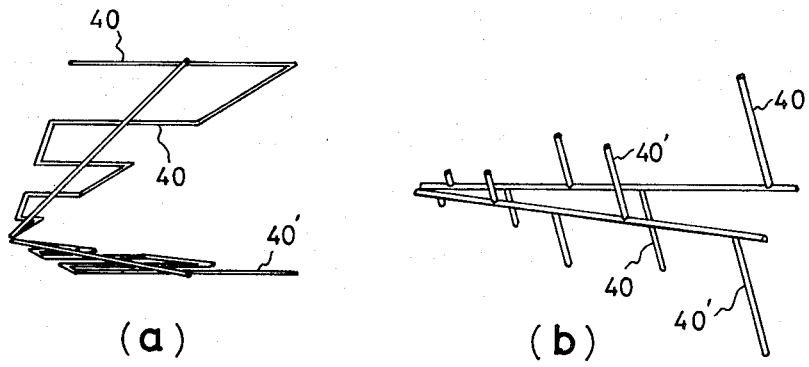
FIGS. 15 (a) and (b) are perspective views representing prior art log-periodic antennas corresponding respectively to the embodiments of FIGS. 14 and 13.

The embodiment of FIG. 13 corresponds to the prior art antenna of FIG. 15 (b) and includes antenna elements 40 each composed of six coaxial cables 1.5D2V of same length having the final end shorted. The lengths H and intervals L of the respective elements are as follows:

| | |
|---|---|
| Lengths (H) of elements: | $40_1$ and $40'_1$ . . . 4.7 cms. |
| | $40_2$ and $40'_2$ . . . 6.5 cms. |
| | $40_3$ and $40'_3$ . . . 9 cms. |
| | $40_4$ and $40'_4$ . . . 12.5 cms. |

-continued

| | |
|---|---|
| | $40_5$ and $40'_5$ . . . 17.2 cms. |
| Intervals: | $L_1$ = 2.2 *cms.* |
| | $L_2$ = 3.0 cms. |
| | $L_3$ = 4.1 cms. |
| | $L_4$ = 5.7 cms. |

The angle of aperture $\psi$ of the rows of elements about the feeding point 42 is 35 degrees. This antenna exhibited an input impedance of about 600 ohms at frequency of 50 MHz and about 850 ohms at 150 MHz and functioned effectively over a wide range of 45 MHz to 350 MHz. Both the length and interval of elements of this antenna are about one-sixth of those of the corresponding prior art antenna of FIG. 15(*b*).

FIG. 14 shows a modification of the antenna of FIG. 13, in which the number of strands constituting each element 40 or 40' is selected to be odd and the outer conductors of the starting and finishing ends of adjoining elements are coupled through conductors 44, which corresponds to the prior art antenna of FIG. 15(*a*).

While, in the above log-periodic antennas, the strands of the respective elements are the same in number and different in length, it is also possible to select the number of strands and the intervals of elements so that all elements are the same in length.

As described above, this invention can be applied not only to simple monopole and dipole antennas, but also the elements of other types of antennas, such as the log-periodic antenna and Yagi antenna, thereby reducing spaces of occupancy of the antennas.

What is claimed is:

1. An antenna comprising at least one fundamental antenna element composed of a coaxial line having a length corresponding to one-half or one-quarter wavelength of utilization waves and divided into a plurality of discrete segments, means connecting said segments in series with the inner conductor of one of the adjoining segments being connected to the outer conductor of the other of said adjoining segments and the outer conductor of said one adjoining segment being connected to the inner conductor of said other adjoining segment, said connecting means forming joints between successive segments and said antenna segments being folded at said joints between successive segments, whereby in-phase unbalanced currents flow in the adjoining segments.

2. An antenna, according to claim 1, wherein each of said segments is straight in shape and said segments are arranged in parallel.

3. An antenna, according to claim 2, wherein said segments are arranged in a plane.

* * * * *